US007607328B2

(12) United States Patent
Ellis

(10) Patent No.: US 7,607,328 B2
(45) Date of Patent: Oct. 27, 2009

(54) LOW PROFILE DEADBOLT ASSEMBLY

(75) Inventor: Philip C. Ellis, Sinking Spring, PA (US)

(73) Assignee: Newfrey, LLC, Newark, DE (US)

( * ) Notice: Subject to any disclaimer, the term of this patent is extended or adjusted under 35 U.S.C. 154(b) by 265 days.

(21) Appl. No.: 11/362,487

(22) Filed: Feb. 24, 2006

(65) Prior Publication Data

US 2007/0199354 A1 Aug. 30, 2007

(51) Int. Cl.
*E05B 65/06* (2006.01)

(52) U.S. Cl. ..... 70/134; 70/370; 70/461; 292/1.5; 292/337

(58) Field of Classification Search ..... 292/1.5, 292/337; 70/134, 370, 461, 466, 372–373, 70/448, 379 R, 351
See application file for complete search history.

(56) References Cited

U.S. PATENT DOCUMENTS 1,661,454 A * 3/1928 Wilson ..... 70/448
3,702,549 A * 11/1972 Solovieff et al. ..... 70/134
5,201,200 A * 4/1993 Hauber ..... 70/107
5,501,492 A * 3/1996 Kajuch ..... 292/1.5
5,676,407 A * 10/1997 Smallegan et al. ..... 292/139
5,765,412 A * 6/1998 Koskela et al. ..... 70/134
6,364,382 B1 * 4/2002 Huang et al. ..... 292/336.5
6,523,375 B2 * 2/2003 Beatty ..... 70/134
6,959,570 B2 * 11/2005 Price ..... 70/493
2007/0199354 A1 * 8/2007 Ellis ..... 70/134
2007/0266747 A1 * 11/2007 Rafferty et al. ..... 70/134

* cited by examiner

*Primary Examiner*—Peter M Cuomo
*Assistant Examiner*—Kristina R Fulton
(74) *Attorney, Agent, or Firm*—Richard J. Veltman, Esq.; Taylor & Aust, P.C.; Ronald K. Aust, Esq.

(57) ABSTRACT

A deadbolt assembly includes a bolt housing having a longitudinal sleeve defining a first axis. A bolt is located in the longitudinal sleeve. An elongate member has a first end and a second end portion opposite the first end, the first end being attached to the proximal end of the bolt and the second end portion having a first connector. A rotatable crank has a pivot member, a second connector and an arm. The second connector of the crank is operationally engaged with the first connector of the elongate member. A first actuator assembly has a body, a lock cylinder, and a tailpiece that extends from the lock cylinder and is rotatable around a second axis with respect to the lock cylinder. The tailpiece is engaged with the pivot member of the crank. At least a portion of the lock cylinder extends past a vertical plane of an outer side surface of the elongate member.

25 Claims, 8 Drawing Sheets

LOW PROFILE DEADBOLT ASSEMBLY

BACKGROUND OF THE INVENTION

1. Field of the Invention

The present invention relates to door lock mechanisms, and, more particularly, to a low profile deadbolt assembly.

2. Description of the Related Art

Keyed locks have long been used to provide security for residences and businesses. A keyed deadbolt assembly often is used to supplement the level of security provided by a simple keyed lock configured integral with a doorknob. A typical deadbolt assembly includes a keyed lock cylinder and a cylinder body that projects about ⅝ of an inch or more away from the surface of a standard 1¾ inch thickness door. In current deadbolt assemblies, the amount that the cylinder body projects away from the surface of the door is determined, at least in part, by the distance required to prevent the lock cylinder from contacting the side of the deadbolt latch. Also, such a deadbolt assembly may be considered aesthetically undesirable, and provides a large profile for tampering by a potential intruder.

SUMMARY OF THE INVENTION

The present invention provides a low profile deadbolt assembly.

The invention, in one form thereof, is directed to a deadbolt assembly that includes a bolt housing having a longitudinal sleeve defining a first axis. A bolt has a distal end and a proximal end. The bolt is located in the longitudinal sleeve, and is configured to move between a fully retracted position and a fully extended position along the first axis. An elongate member has a first end and a second end portion opposite the first end, the first end being attached to the proximal end of the bolt and the second end portion having a first connector. The elongate member has a first outer side surface and a second outer side surface, the second outer side surface being spaced apart from the first outer side surface. A rotatable crank has a pivot member, a second connector and an arm extending between the pivot member and the second connector. The second connector of the crank is operationally engaged with the first connector of the elongate member. A first actuator assembly has a body, a lock cylinder and a tailpiece. The lock cylinder is mounted to the body, and the tailpiece extends from the lock cylinder. The tailpiece is rotatable around a second axis with respect to the lock cylinder, and the tailpiece is engaged with the pivot member to facilitate rotation of the crank with a corresponding rotation of the tailpiece around the second axis. At least a portion of the lock cylinder extends past a vertical plane of the first outer side surface of said elongate member.

The invention, in another form thereof, is directed to a deadbolt assembly, including a bolt housing having a longitudinal sleeve defining a first axis. A bolt has a distal end and a proximal end. The bolt is located in the longitudinal sleeve and configured to move between a fully retracted position and a fully extended position. A first actuator assembly has a body, a lock cylinder and a drive. The lock cylinder is mounted to the body, and the drive extends from the lock cylinder. The drive is rotatable around a second axis with respect to the lock cylinder. A slide member has a first end and a second end portion opposite the first end. The first end is attached to the proximal end of the bolt and the second end portion has a first connector. A rotatable crank has a pivot member, a second connector and an arm extending between the pivot member and the second connector. The pivot member is engaged with the drive of the first actuator assembly to facilitate rotation of the crank with a corresponding rotation of the drive around the second axis. The second connector of the crank is operationally engaged with the first connector of the slide member. A stationary guide rail is attached to the bolt housing. The guide rail defines a third axis that is substantially parallel to the first axis, and the slide member is configured for longitudinal movement along the third axis when the bolt is moved between the fully retracted position and the fully extended position. The stationary guide rail has a notch to provide a clearance between a first perimetrical surface of the lock cylinder and a second perimetrical surface of the stationary guide rail to accommodate an extent of the lock cylinder.

The invention, in another form thereof, is directed to a deadbolt assembly. The deadbolt assembly includes a bolt housing having a longitudinal sleeve defining a first axis. A bolt has a distal end and a proximal end. The bolt is located in the longitudinal sleeve and configured to move between a fully retracted position and a fully extended position. An elongate member has a first end, a second end portion opposite the first end, a first outer side surface and a second outer side surface spaced apart from the first outer side surface. The first end is attached to the proximal end of the bolt, and the second end portion has a first connector. A first actuator assembly has a body, a lock cylinder and a tailpiece. The lock cylinder is mounted to the body, and the tailpiece extends from the lock cylinder. The tailpiece is rotatable with respect to the lock cylinder around a second axis. A second actuator assembly includes a mounting plate, a turnpiece and a crank. The crank has a pivot member, a second connector and an arm extending between the pivot member and the second connector. The second connector of the crank is operationally engaged with the first connector of the elongate member. The turnpiece and the crank are rotatably mounted to the mounting plate. The pivot member of the crank is connected to the turnpiece and to the tailpiece to facilitate rotation of the crank with a corresponding rotation of the turnpiece and the tailpiece around the second axis. The arm of the crank is interposed between the second outer side surface of the elongate member and the mounting plate of the second actuator assembly.

The invention, in another form thereof, is directed to a method of assembling a deadbolt assembly including a bolt housing having a longitudinal sleeve defining a first axis; a bolt having a distal end and a proximal end, the bolt being located in the longitudinal sleeve and configured to move between a fully retracted position and a fully extended position along the first axis; and an elongate member having a first end and a second end portion opposite the first end, the first end being attached to the proximal end of the bolt and the second end portion having a first connector. The elongate member has a first outer side surface and a second outer side surface. The second outer side surface is spaced apart from the first outer side surface. The method includes providing a rotatable crank having a pivot member, a second connector and an arm extending between the pivot member and the second connector; operationally engaging the second connector of the crank with the first connector of the elongate member; providing a first actuator assembly having a body, a lock cylinder and a tailpiece, the lock cylinder being mounted to the body, and the tailpiece extending from the lock cylinder, the tailpiece being rotatable around a second axis with respect to the lock cylinder; engaging the tailpiece with the pivot member of the crank to facilitate rotation of the crank with a corresponding rotation of the tailpiece around the second axis; and positioning at least a portion of the lock cylinder to extend past a vertical plane of the first outer side surface of the elongate member.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
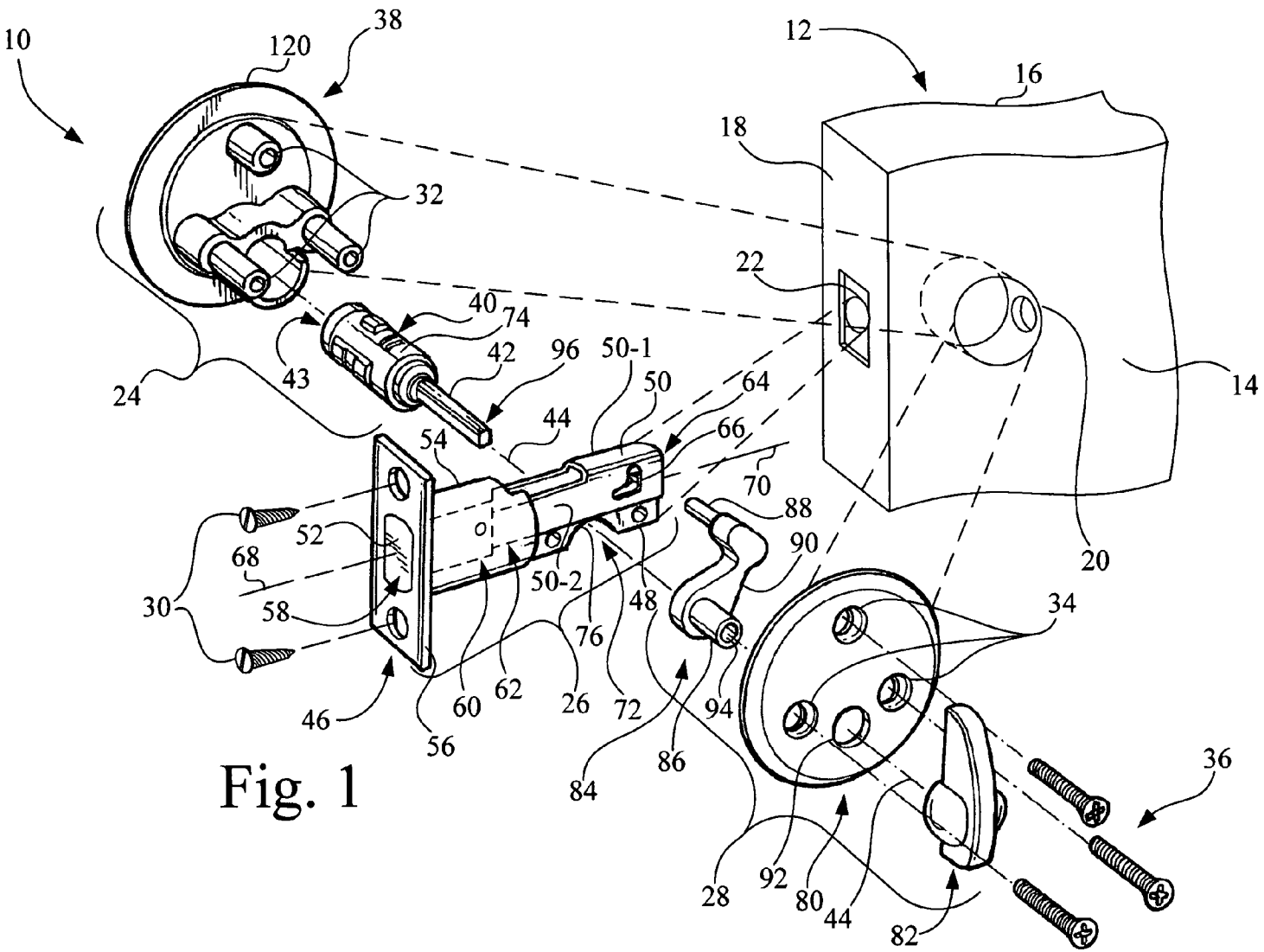
FIG. 1 is an exploded perspective view of a deadbolt assembly configured in accordance with an embodiment of the present invention.
Figure 2:
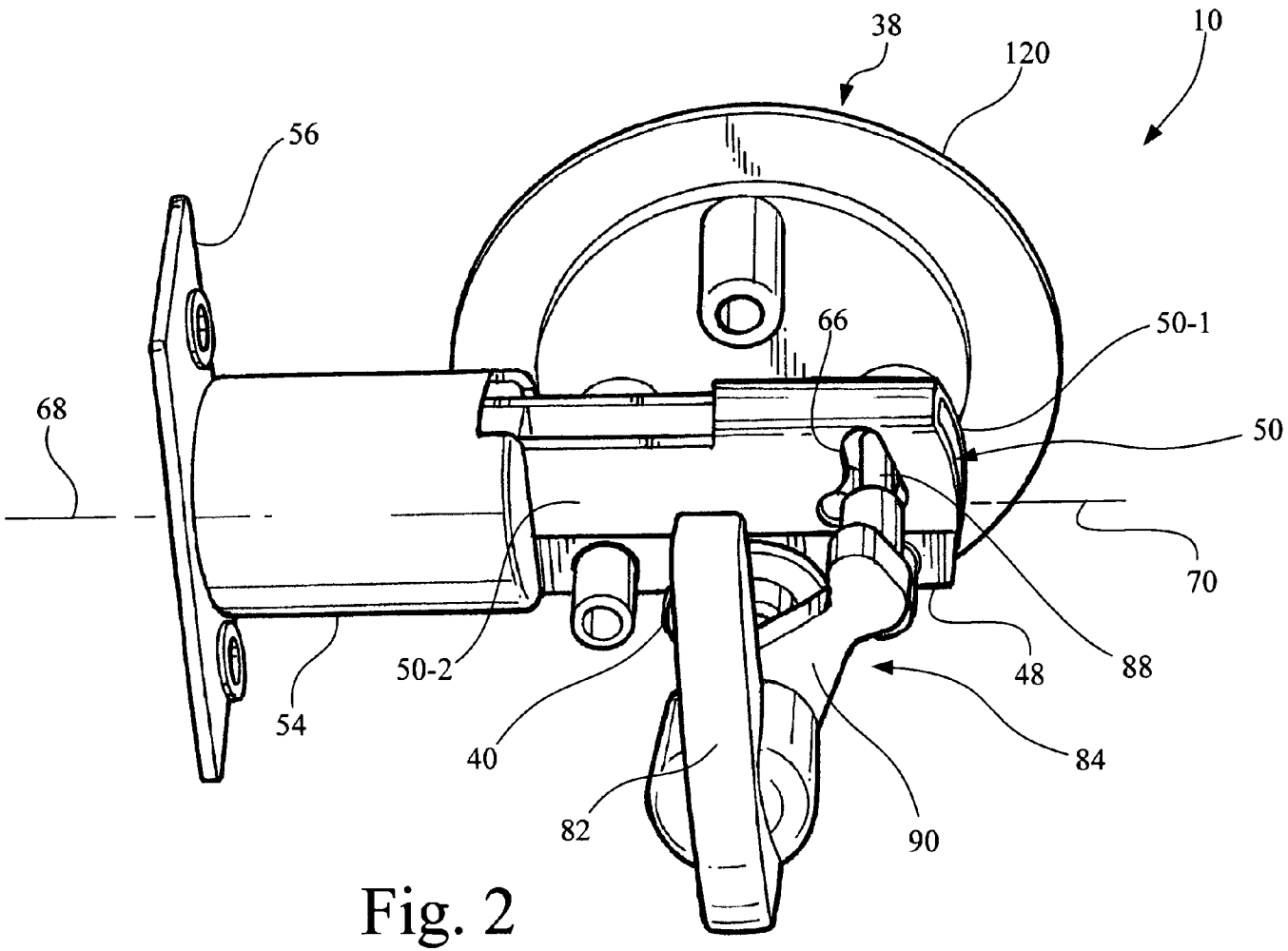
FIG. 2 is a side perspective view of the deadbolt assembly, viewed toward a keyed actuator assembly, with a turnpiece installed.
Figure 3:
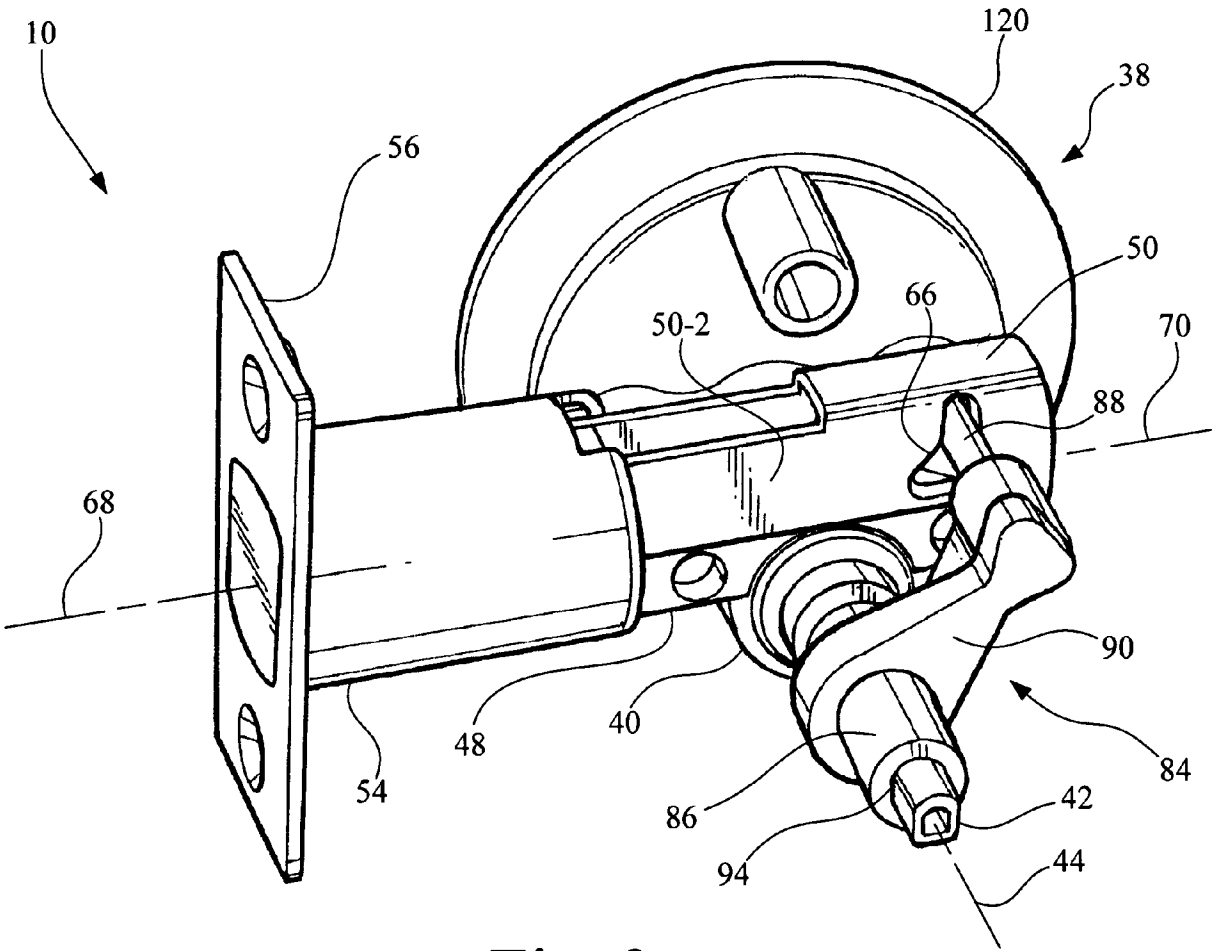
FIG. 3 is a side perspective view of the deadbolt assembly, viewed toward the keyed actuator assembly, with the turnpiece removed.

Referring now to the drawings and particularly to FIG. 1, there is shown an exploded perspective view of a low profile deadbolt assembly 10 configured in accordance with an embodiment of the present invention. Projection lines show the general locations of the various components of deadbolt assembly 10 in relation to a door 12. Door 12 includes an interior side 14, an exterior side 16, an end 18, a through bore 20 and an edge bore 22. Through bore 20 passes through door 12 from exterior side 16 to interior side 14. Edge bore 22 passes through door 12 from end 18 to intersect with through bore 20.

FIGS. 2-8 show deadbolt assembly 10 of FIG. 1 at various viewing angles to aid the reader in understanding the present invention. Deadbolt assembly 10 includes a keyed low profile actuator assembly 24, a deadbolt latch assembly 26, and an interior actuator assembly 28. During assembly, deadbolt latch assembly 26 is inserted into edge bore 22 of door 12 and attached to end 18 of door 12 via a pair of screws 30. Keyed actuator assembly 24 is inserted into through bore 20 from exterior side 16, but does not engage deadbolt latch assembly 26. Interior actuator assembly 28 is inserted into through bore 20 from interior side 14 of door 12, and engages both keyed actuator assembly 24 and deadbolt latch assembly 26. Keyed actuator assembly 24 includes threaded holes 32 and interior actuator assembly 28 includes smooth holes 34. Machine screws 36 pass through the smooth holes 34 in interior actuator assembly 28 and are threaded into threaded holes 32 of keyed actuator assembly 24 to mount keyed actuator assembly 24 and interior actuator assembly 28 to door 12.

Keyed actuator assembly 24 includes a body 38, a lock cylinder 40 and a tailpiece 42. Lock cylinder 40 is mounted to body 38, and has a keyed interior lock mechanism 43 that is rotatable. Tailpiece 42 extends from lock cylinder 40 and is connected to keyed interior lock mechanism 43. Keyed interior lock mechanism 43 is a lost motion device, such that a key operating keyed interior lock mechanism 43 of lock cylinder 40 may be turned by an amount, e.g., 90 degrees, before effecting a rotation of tailpiece 42 around an axis 44, with respect to lock cylinder 40.

Deadbolt latch assembly 26 includes a bolt housing 46, a stationary guide rail 48, an elongate member, e.g., slide, 50 and a bolt 52. Bolt housing 46 is configured to include a longitudinal sleeve 54, and provides a base plate 56 fixedly attached to the sleeve 54 for mounting bolt housing 46 to door 12. Bolt 52 is located in longitudinal sleeve 54. Bolt 52 has a distal end 58 and a proximal end 60.

Elongate slide 50 has an end 62 and an end portion 64. End portion 64 is at the opposite end of elongate slide 50 with respect to end 62. End 62 is attached to proximal end 60 of bolt 52. End portion 64 includes a connector, e.g., an irregular (L-shaped) aperture, 66. Elongate slide 50 has a first outer side surface 50-1 and a second outer side surface 50-2. First outer side surface 50-1 of elongate slide 50 faces toward exterior side 16 of door 12 and second outer side surface 50-2 faces toward interior side 14 of door 12. Longitudinal sleeve 54 defines an axis 68 for bolt 52, along which bolt 52 is moved via a longitudinal linear movement of elongate slide 50.

Figure 4:
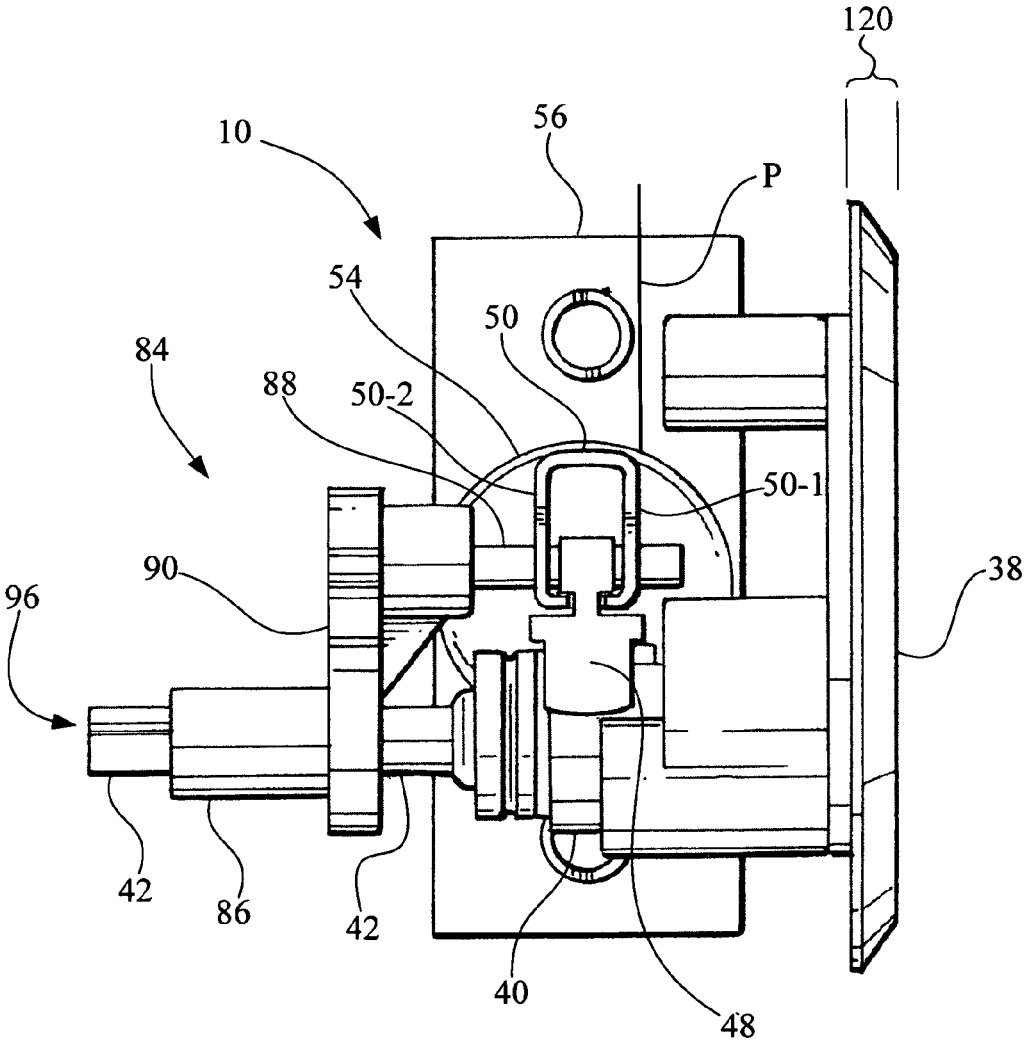
FIG. 4 is an interior end view of the deadbolt assembly of FIG. 3.
Figure 5:
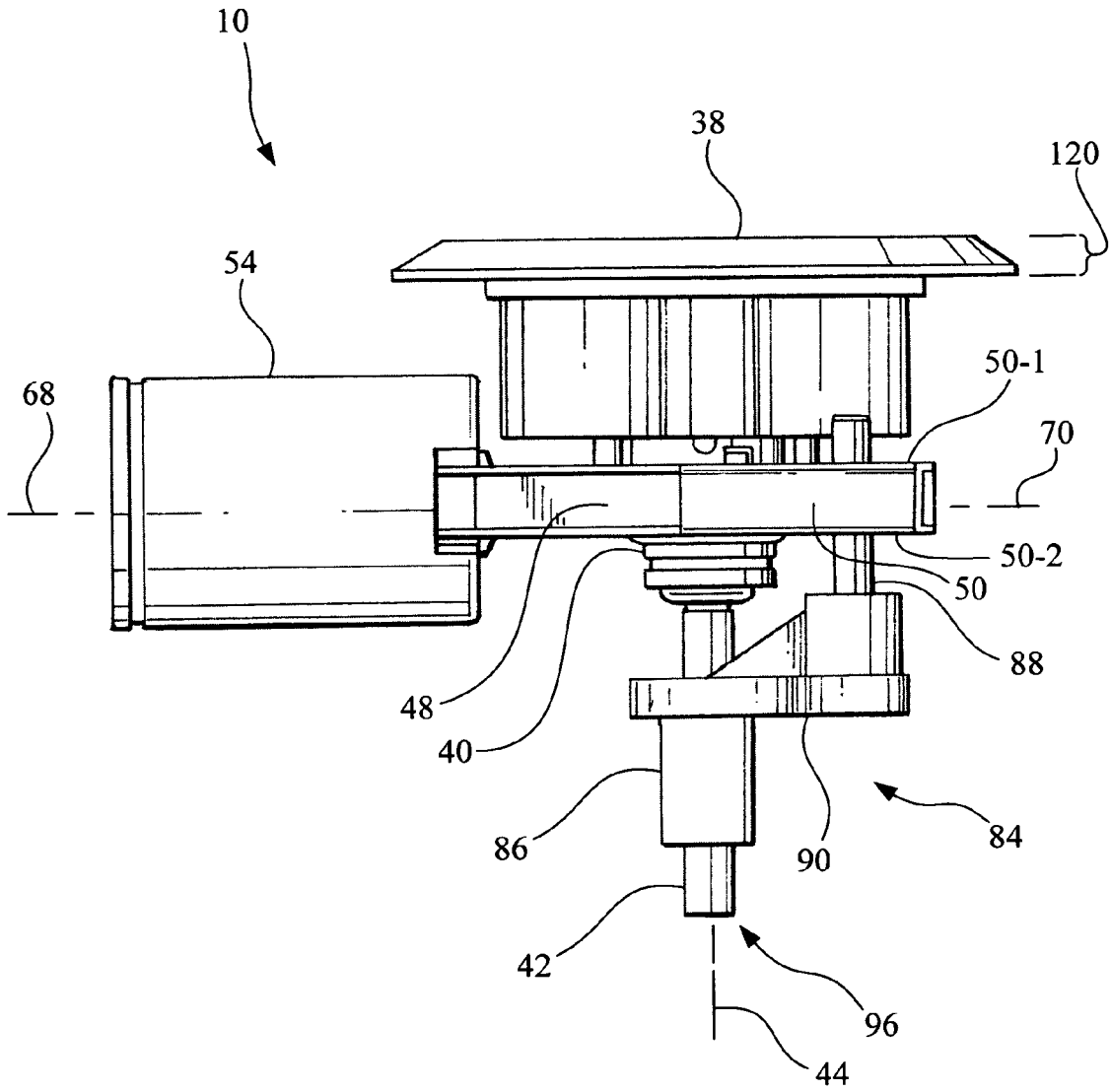
FIG. 5 is a top view of the deadbolt assembly of FIG. 3.
Figure 6:
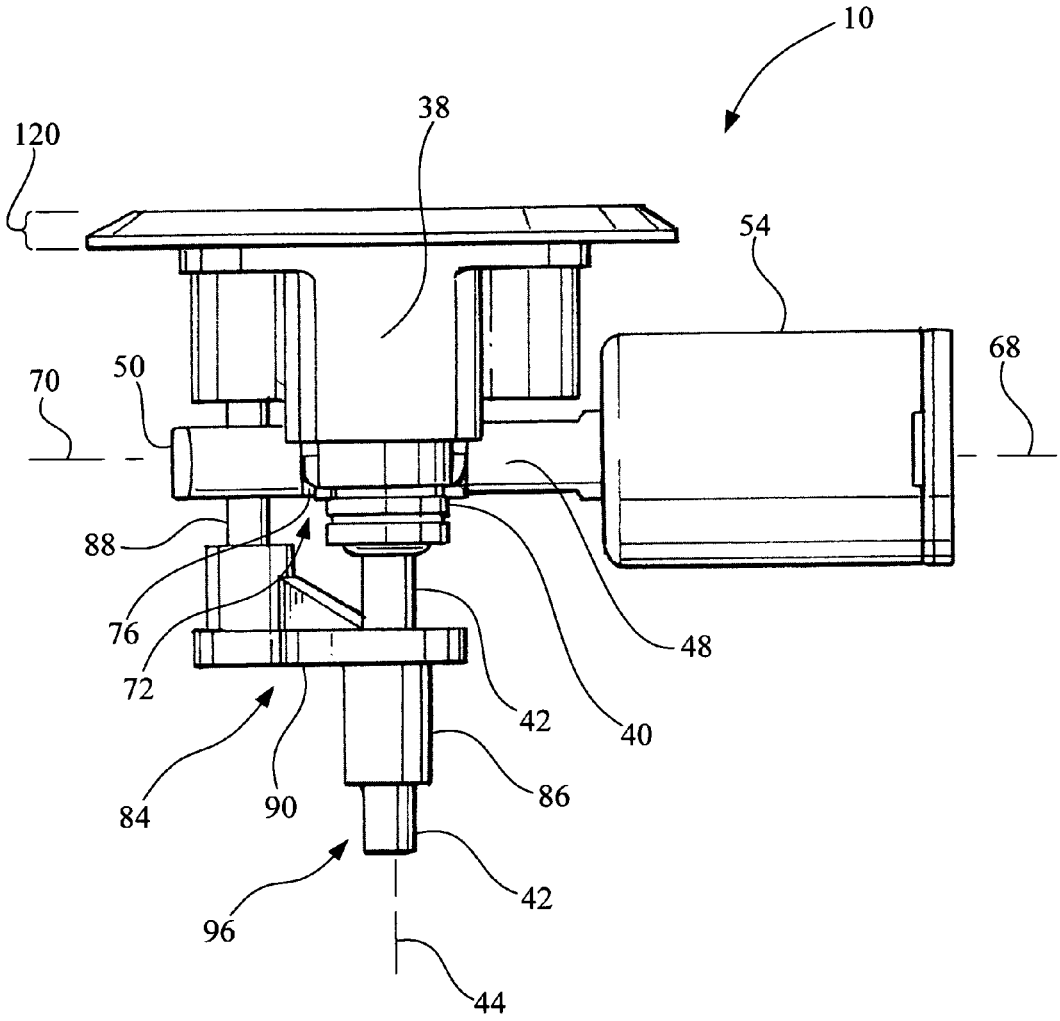
FIG. 6 is a bottom view of the deadbolt assembly of FIG. 3.
Figure 7:
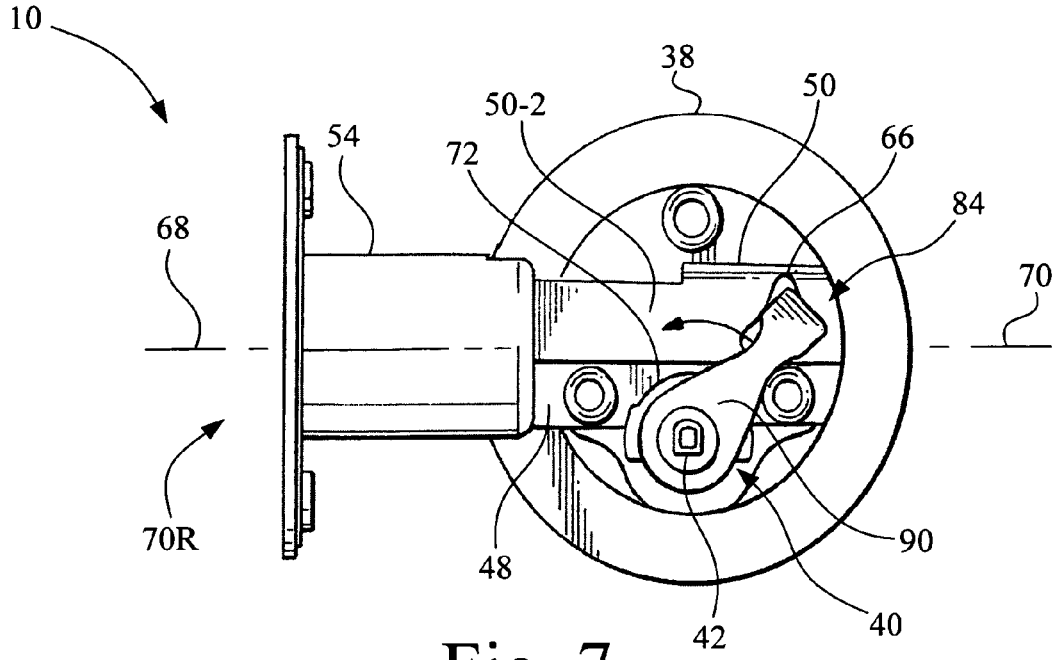
FIG. 7 is a side view of the deadbolt assembly of FIG. 3 showing the bolt in the fully retracted position.
Figure 8:
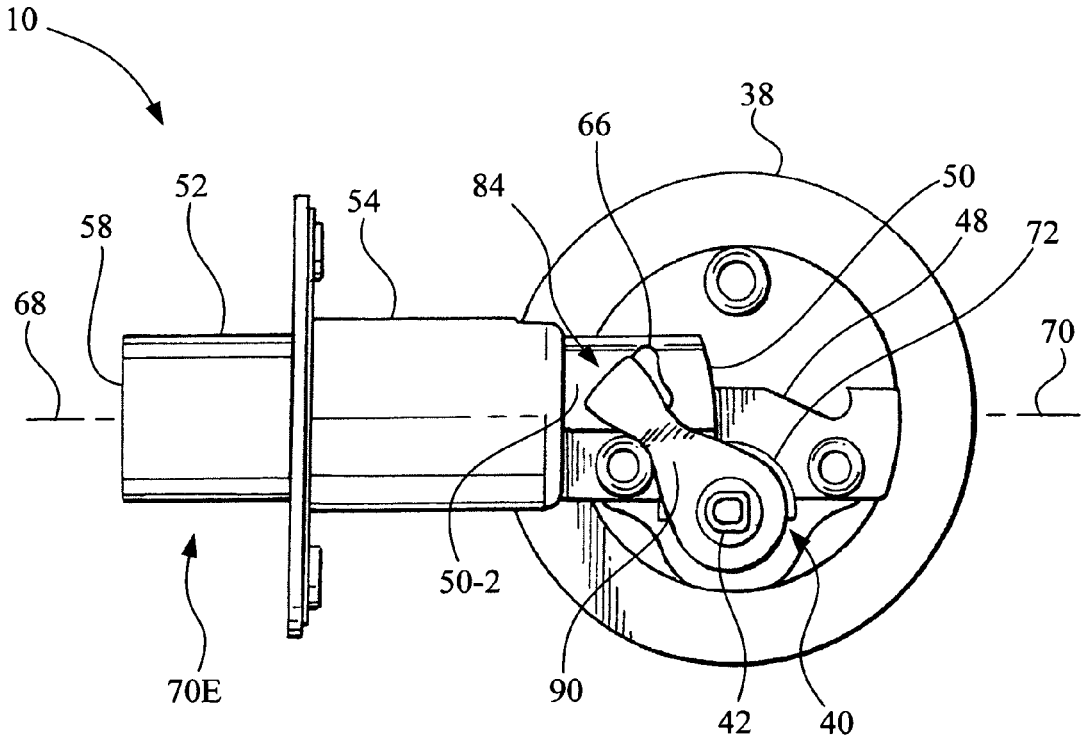
FIG. 8 is a side view of the deadbolt assembly of FIG. 3 showing the bolt in the fully extended position.

Stationary guide rail 48 is attached to bolt housing 46. Guide rail 48 defines an axis of longitudinal movement 70, which is substantially parallel to axis 68 of bolt 52, and substantially orthogonal to axis 44 of pivot member 86 of crank 84. In this embodiment, elongate slide 50 is configured for only longitudinal movement along axis 70 along stationary guide rail 48 when bolt 52 is moved between a fully retracted position 70R and a fully extended position 70E, as shown in FIGS. 7 and 8. Stationary guide rail 48 has a notch 72 to provide a clearance between a perimetrical, e.g., an upper, surface 74 of lock cylinder 40 and a perimetrical, e.g., a lower, surface 76 of stationary guide rail 48 to accommodate an extent of lock cylinder 40 under stationary guide rail 48. In turn, as shown in FIG. 4, at least a portion of lock cylinder 40 extends past a vertical plane P of first outer side surface 50-1 of elongate slide 50 when lock cylinder 40 is positioned under, or alternatively over, elongate slide 50 and stationary guide rail 48.

Interior actuator assembly 28 includes a mounting plate 80, a turnpiece 82 and a crank 84. Turnpiece 82 is configured to be grasped and rotated by a user to operate bolt 52. Crank 84 has a pivot member 86, a second connector, e.g., pin, 88, and an arm 90 extending between pivot member 86 and second connector 88. Crank 84 is rotatably mounted to mounting plate 80 by inserting pivot member 86 into an opening 92 in mounting plate 80. Thereafter, turnpiece 82 is connected to pivot member 86, such as for example, via a setscrew.

Pivot member 86 includes a keyed opening 94 sized to slidably receive an end portion 96 of tailpiece 42. Pivot member 86 of crank 84 is thus connected to turnpiece 82 and to tailpiece 42 to facilitate rotation of crank 84 with a corresponding rotation of turnpiece 82 and/or tailpiece 42 around axis 44.

Connector 88 (e.g., a pin) of crank 84 is operationally engaged with connector 66 (e.g., L-shaped aperture) of elongate slide 50. In embodiments wherein one of connector 66 and connector 88 is a pin and the other of connector 66 and connector 88 is an aperture, the pin extends in a direction substantially parallel to axis 44 to engage the aperture.

Arm 90 of crank 84 is interposed between the second outer side surface 50-2 of elongate slide 50 of deadbolt latch assembly 26 and mounting plate 80 of interior actuator assembly 28. Stated in another way, arm 90 of crank 84 is positioned between the second outer side surface 50-2 of elongate slide 50 and the interior side 14 of door 12.

Figure 9:
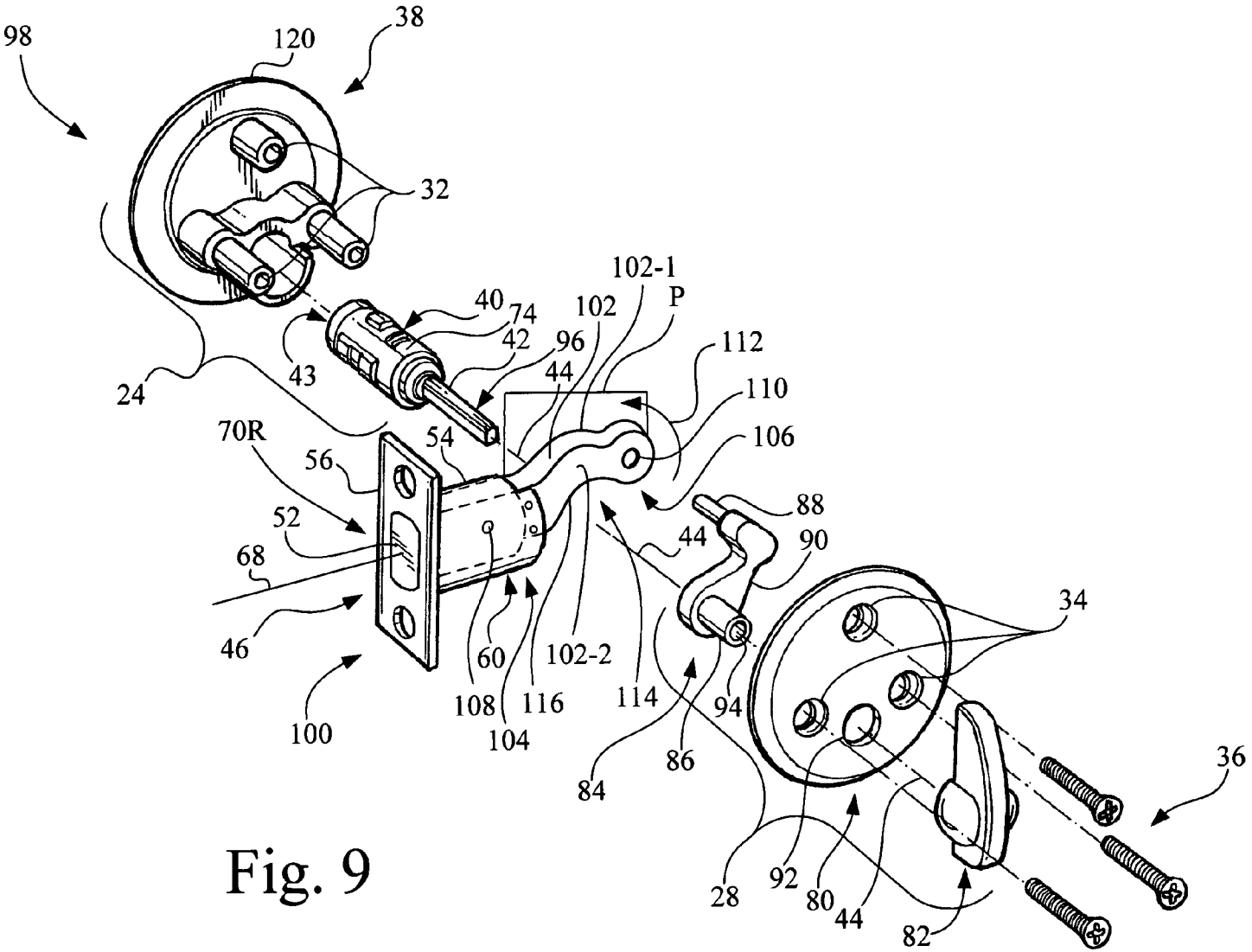
FIG. 9 is an exploded perspective view of a deadbolt assembly configured in accordance with another embodiment of the present invention.

FIG. 9 is another embodiment of the present invention, identified as deadbolt assembly 98, wherein deadbolt latch assembly 26 of the embodiment of FIG. 1 is replaced with a deadbolt latch assembly 100. In this embodiment, the structure of keyed actuator assembly 24 and interior actuator assembly 28 are identical to the embodiment of FIG. 1.

Deadbolt latch assembly 100 includes bolt housing 46, bolt 52, and an elongate member 102. Elongate member 102 has an end 104 and an end portion 106 opposite end 104. End 104 is attached to proximal end 60 of bolt 52 via a pivot member, e.g., a pin, 108. End portion 106 includes a connector, e.g., a hole, 110. Elongate member 102 has a first outer side surface 102-1 and a second outer side surface 102-2.

First outer side surface 102-1 of elongate member 102 faces toward exterior side 16 of door 12 and second outer side surface 102-2 faces toward interior side 14 of door 12 (see FIG. 1). Longitudinal sleeve 54 defines axis 68 for bolt 52, along which bolt 52 is moved between a fully retracted position 70R and a fully extended position 70E, (see also FIGS. 7 and 8) via a movement of elongate member 102 along an arcuate path 112, as represented in FIG. 9 by a curved arrow.

Elongate member 102 is shaped to define a notch 114, e.g., has a curved shape, to provide a clearance between the perimetrical, e.g., an upper, surface 74 of lock cylinder 40 and a perimetrical, e.g., lower, surface 116 of elongate member 102 to accommodate an extent of lock cylinder 40 past, e.g., under or over, elongate member 102. In turn, as shown in FIG. 9, at least a portion of lock cylinder 40 extends past a vertical plane P of first outer side surface 102-1 of elongate member 102 when lock cylinder 40 is positioned under elongate member 102.

Connector 88 (e.g., a pin) of crank 84 is operationally engaged with connector 110 (e.g., hole) of elongate member 102. In embodiments wherein one of connector 66 and connector 110 is a pin and the other of connector 88 and connector 110 is a hole, the pin extends in a direction substantially parallel to axis 44 to engage the aperture.

Arm 90 of crank 84 is interposed between the second outer side surface 102-2 of elongate member 102 of deadbolt latch assembly 100 and mounting plate 80 of interior actuator assembly 28. Stated in another way, arm 90 of crank 84 is positioned between the second outer side surface of 102-2 of elongate member 102 and the interior side 14 of door 12.

In the embodiments of the present invention described above, as shown for example in FIGS. 1, 4-6, and 9, by configuring deadbolt assemblies 10 and 98 such that lock cylinder 40 may extend at least partially under the respective elongate member 50, 102, the exterior portion 120 of body 38 of keyed actuator assembly 24 may present a low profile with respect to exterior side 16 of door 12 such that, for example, the exterior portion 120 of body 38 of keyed actuator assembly 24 may only project outwardly from exterior side 16 of door 12 by a small distance, e.g., about a quarter of an inch (6.4 millimeters) or less, including a distance of zero or negative distances, via use of a counter bore. Thus, there actually is no minimum height for the exterior portion 120 of body 38 of keyed actuator assembly 24, since if the through bore 20 were counter bored, the exterior portion 120 could be made flush or recessed with respect to the door surface, e.g., exterior side 16 of door 12.

Also, by configuring deadbolt assemblies 10 and 98 as described above, a deadbolt assembly may be configured for use with thin doors (e.g., interior doors having a thickness of 1⅜ inches) without using adaptors or increasing the projection above the door surface.

While this invention has been described with respect to embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A deadbolt assembly, comprising:

a bolt housing having a longitudinal sleeve defining a first axis;

a bolt having a distal end and a proximal end, said bolt being located in said longitudinal sleeve and configured to move between a fully retracted position and a fully extended position along said first axis;

an elongate member having a first end and a second end portion opposite said first end, said first end being attached to said proximal end of said bolt and said second end portion having a first connector, said elongate member having a first outer side surface and a second outer side surface, said second outer side surface being spaced apart from said first outer side surface;

a rotatable crank having a pivot member, a second connector and an arm extending between said pivot member and said second connector, said second connector of said crank being operationally engaged with said first connector of said elongate member; and a first actuator assembly having a body, a lock cylinder and a tailpiece, said lock cylinder being mounted to said body, and said tailpiece extending from said lock cylinder, said tailpiece being rotatable around a second axis with respect to said lock cylinder, and said tailpiece being engaged with said pivot member to facilitate rotation of said crank with a corresponding rotation of said tailpiece around said second axis, and wherein at least a portion of said lock cylinder extends past a vertical plane of said first outer side surface of said elongate member, further comprising a guide rail, said guide rail having a notch wherein said lock cylinder defines a perimetrical surface that is positioned within said notch of said guide rail, with a perimetrical surface of said notch accommodating an extent of said lock cylinder.

2. The deadbolt assembly of claim 1, wherein said lock cylinder is positioned at one of under and over said elongate member.

3. The deadbolt assembly of claim 1 wherein when mounted to a door having an interior side, an exterior side, and a bore passing through said door from said exterior side to said interior side, said first actuator assembly is inserted into said bore from said exterior side toward said interior side, said first outer side surface of said elongate member facing toward said exterior side of said door and said second outer side surface facing toward said interior side of said door, wherein said arm of said crank is positioned between said second outer side surface of said elongate member and said interior side of said door.

4. The deadbolt assembly of claim 1, further comprising a second actuator assembly including a mounting plate, a turnpiece and said crank, wherein said turnpiece and said crank are rotatably mounted to said mounting plate, said pivot member of said crank being connected to said turnpiece to facilitate rotation of said crank with a corresponding rotation of said turnpiece around said second axis, and wherein said arm of said crank is interposed between said second outer side surface of said elongate member and said mounting plate of said second actuator assembly.

5. The deadbolt assembly of claim 1, wherein said guide rail is a stationary guide rail attached to said bolt housing, said stationary guide rail defining a third axis that is substantially parallel to said first axis, and said elongate member being configured for only longitudinal movement along said third axis when said bolt is moved between said fully retracted position and said fully extended position.

6. The deadbolt assembly of claim 1, wherein said first end of said elongate member is attached by a pivot member to said bolt, and wherein said second end portion of said elongate member travels in an arcuate path when said bolt is moved between said fully retracted position and said fully extended position via rotation of said crank.

7. The deadbolt assembly of claim 6, wherein said elongate member is shaped to define a notch to provide a clearance between a first perimetrical surface of said lock cylinder and a second perimetrical surface of said elongate member to accommodate an extent of said lock cylinder past said elongate member.

8. The deadbolt assembly of claim 7, wherein said elongate member has a curved shape.

9. The deadbolt assembly of claim 1, wherein one of said first connector and said second connector is an aperture, and the other of said first connector and said second connector is a pin extending in a direction substantially parallel to said second axis to engage said aperture.

10. A deadbolt assembly, comprising:

a bolt housing having a longitudinal sleeve defining a first axis;

a bolt having a distal end and a proximal end, said bolt being located in said longitudinal sleeve and configure to move between a fully retracted position and a fully extended position;

a first actuator assembly having a body, a lock cylinder and a drive, said lock cylinder being mounted to said body, and said drive extending from said lock cylinder, said drive being rotatable around a second axis with respect to said lock cylinder;

a slide member having a first end and a second end portion opposite said first end, said first end being attached to said proximal end of said bolt and said second end portion having a first connector;

a rotatable crank having a pivot member, a second connector and an arm extending between said pivot member and said second connector, said pivot member being engaged with said drive of said first actuator assembly to facilitate rotation of said crank with a corresponding rotation of said drive around said second axis, and said second connector of said crank being operationally engaged with said first connector of said slide member; and a stationary guide rail attached to said bolt housing, said guide rail defining a third axis that is substantially parallel to said first axis, and said slide member being configured for longitudinal movement along said third axis when said bolt is moved between said fully retracted position and said fully extended position, said stationary guide rail having a notch, and said lock cylinder having an upper surface positioned within said notch of said stationary guide rail, with a clearance between said upper surface of said lock cylinder and a lower surface defined by said notch to accommodate an extent of said lock cylinder.

11. The deadbolt assembly of claim 10, said slide member having a first outer side surface and a second outer side surface, said second outer side surface being spaced apart from said first outer side surface, wherein at least a portion of said lock cylinder extends past a vertical plane of said first outer side surface of said slide member.

12. The deadbolt assembly of claim 11 wherein when mounted to a door having an interior side, an exterior side, and a bore passing through said door from said exterior side to said interior side, said first actuator assembly is inserted into said bore from said exterior side toward said interior side, said first outer side surface of said slide member facing toward said exterior side of said door and said second outer side surface facing toward said interior side of said door, wherein said arm of said crank is positioned between said second outer side surface of said slide member and said interior side of said door.

13. The deadbolt assembly of claim 11, further comprising a second actuator assembly including a mounting plate, a turnpiece and said crank, wherein said turnpiece and said crank are rotatably mounted to said mounting plate, said pivot member of said crank being connected to said turnpiece to facilitate rotation of said crank with a corresponding rotation of said turnpiece around said second axis, and wherein said arm of said crank is interposed between said second outer side surface of said slide member and said mounting plate of said second actuator assembly.

14. The deadbolt assembly of claim 10, wherein one of said first connector and said second connector is an aperture, and the other of said first connector and said second connector is a pin extending in a direction substantially parallel to said second axis to engage said aperture.

15. A deadbolt assembly, comprising:

a bolt housing having a longitudinal sleeve defining a first axis;

a bolt having a distal end and a proximal end, said bolt being located in said longitudinal sleeve and configure to move between a fully retracted position and a fully extended position;

an elongate member having a first end, a second end portion opposite said first end, a first outer side surface and a second outer side surface spaced apart from said first outer side surface, said first end being attached to said proximal end of said bolt, and said second end portion having a first connector;

a guide rail attached to said bolt housing, said elongate member being configured for longitudinal movement relative to said guide rail, said guide rail having a notch;

a first actuator assembly having a body, a lock cylinder and a tailpiece, said lock cylinder being mounted to said body, and said tailpiece extending from said lock cylinder, said tailpiece being rotatable with respect to said lock cylinder around a second axis, said lock cylinder having an outer surface that is positioned within said notch of said guide rail; and said notch providing a clearance between a surface of said lock cylinder and a surface of said guide rail to accommodate an extent of said lock cylinder a second actuator assembly including a mounting plate, a turnpiece and a crank, said crank having a pivot member, a second connector and an arm extending between said pivot member and said second connector, said second connector of said crank being operationally engaged with said first connector of said elongate member, said turnpiece and said crank being rotatably mounted to said mounting plate, said pivot member of said crank being connected to said turnpiece and to said tailpiece to facilitate rotation of said crank with a corresponding rotation of said turnpiece and said tailpiece around said second axis, and wherein said arm of said crank is interposed between said second outer side surface of said elongate member and said mounting plate of said second actuator assembly.

16. The deadbolt assembly of claim 15, said guide rail defining a third axis that is substantially parallel to said first axis, and said elongate member being configured for longitudinal movement along said third axis when said bolt is moved between said fully retracted position and said fully extended position.

17. The deadbolt assembly of claim 15, wherein said first end of said elongate member is attached by a pivot member to said bolt, wherein said second end portion travels in an arcuate path when said bolt is moved between said fully retracted position and said fully extended position via rotation of said crank.

18. The deadbolt assembly of claim 15, wherein one of said first connector and said second connector is an aperture, and the other of said first connector and said second connector is a pin extending in a direction substantially parallel to said second axis to engage said aperture.

19. The deadbolt assembly of claim 15, wherein said elongate member is shaped to define a second notch to provide a clearance between an upper surface of said lock cylinder and a lower surf ace of said elongate member to accommodate an extent of said lock cylinder under said elongate member.

20. The deadbolt assembly of claim 19, wherein said elongate member has a curved shape.

21. A method of assembling a deadbolt assembly including a bolt housing having a longitudinal sleeve defining a first axis, a bolt having a distal end and a proximal end, said bolt being located in said longitudinal sleeve and configured to move between a fully retracted position and a fully extended position along said first axis; an elongate member having a first end and a second end portion opposite said first end, said elongate member having a first outer side surface and a second outer side surface, said second outer side surface being spaced apart from said first outer side surface; and a guide rail attached to said bolt housing, said elongate member being configured for longitudinal movement relative to said guide rail, said guide rail having a notch, said method comprising:

providing a rotatable crank having a pivot member, a second connector and an arm extending between said pivot member and said second connector;

operationally engaging said second connector of said crank with said first connector of said elongate member;

providing a first actuator assembly having a body, a lock cylinder and a tailpiece, said lock cylinder being mounted to said body, and said tailpiece extending from said lock cylinder, said tailpiece being rotatable around a second axis with respect to said lock cylinder;

engaging said tailpiece with said pivot member of said crank to facilitate rotation of said crank with a corresponding rotation of said tailpiece around said second axis; and positioning at least a portion of said lock cylinder to extend past a vertical plane of said first outer side surface of said elongate member, with an outer surface of said lock cylinder being positioned within said notch of said guide rail.

22. The method of claim 21, said method further comprising:

positioning at least a portion of said lock cylinder at one of under and over said elongate member.

23. The method of claim 21, wherein when mounting to a door having an interior side, an exterior side, and a bore passing through said door from said exterior side to said interior side, said first outer side surface of said elongate member facing toward said exterior side of said door and said second outer side surface facing toward said interior side of said door, said method further comprising:

inserting said first actuator assembly into said bore from said exterior side of said door toward said interior side of said door;

providing a second actuator assembly including a mounting plate, a turnpiece and said crank, wherein said turnpiece and said crank are rotatably mounted to said mounting plate;

inserting said second actuator assembly into said bore from said interior side of said door toward said exterior side of said door;

connecting said pivot member of said crank to said turnpiece to facilitate rotation of said crank with a corresponding rotation of said turnpiece around said second axis; and interposing said arm of said crank between said second outer side surface of said elongate member and said mounting plate of said second actuator assembly.

24. A deadbolt assembly, comprising:

a bolt housing having a longitudinal sleeve defining a first axis;

a bolt having a distal end and a proximal end, said bolt being located in said longitudinal sleeve and configured to move between a fully retracted position and a fully extended position along said first axis;

an elongate member having a first end and a second end portion opposite said first end, said first end being attached to said proximal end of said bolt and said second end portion having a first connector, said elongate member having a first outer side surface and a second outer side surface, said second outer side surface being spaced apart from said first outer side surface;

a guide rail attached to said bolt housing, said elongate member being configured for longitudinal movement relative to said guide rail, said guide rail having a notch;

a rotatable crank having a pivot member, a second connector and an arm extending between said pivot member and said second connector, said second connector of said crank being operationally engaged with said first connector of said elongate member; and a first actuator assembly having a body, a lock cylinder and a tailpiece, said lock cylinder being mounted to said body, and said tailpiece extending from said lock cylinder, said tailpiece being rotatable around a second axis with respect to said lock cylinder, and said tailpiece being engaged with said pivot member to facilitate rotation of said crank with a corresponding rotation of said tailpiece around said second axis, and wherein at least a portion of said lock cylinder extends past a vertical plane of said first outer side surface of said elongate member, and wherein said lock cylinder defines an outer surface, said outer surface being positioned within said notch of said guide rail.

25. The deadbolt assembly of claim 24, wherein said outer surface is an upper surface of said lock cylinder.

* * * * *